US005422453A

United States Patent [19]

Smith et al.

[11] Patent Number: 5,422,453

[45] Date of Patent: Jun. 6, 1995

[54] HANDLE ACTUATOR FOR A CIRCUIT INTERRUPTER HANDLE

[75] Inventors: George A. Smith, N. Huntingdon Township, Westmoreland County; Thomas K. Fogle, Pittsburgh; Mark L. Lotzmann, Irwin, all of Pa.

[73] Assignee: Eaton Corporation, Cleveland, Ohio

[21] Appl. No.: 127,919

[22] Filed: Sep. 28, 1993

[51] Int. Cl.[6] ..... H01H 9/26

[52] U.S. Cl. ..... 200/329; 200/331; 200/336; 200/337; 200/338; 307/64

[58] Field of Search ..... 200/5 B, 5 C, 50 C, 200/50 R, 329, 332, 335, 336, 337, 330, 331, 18, 501, 338; 307/64, 65, 85; 335/160, 161, 68, 122; 74/473 R, 480 R, 483 R, 544, 22 R, 23, 480 R

[56] References Cited

U.S. PATENT DOCUMENTS

| | | | |
|---|---|---|---|
| 2,431,387 | 6/1946 | Fiorenza | 16/114 |
| 3,236,967 | 2/1966 | Bottonari et al. . | |
| 3,652,815 | 3/1972 | Davies . | |
| 3,689,721 | 9/1972 | Mc Guffie . | |
| 3,773,995 | 11/1973 | Davies . | |
| 3,778,633 | 12/1973 | De Visser et al. | 307/64 |
| 3,806,684 | 4/1974 | Hauser . | |
| 4,021,678 | 3/1977 | Moakler et al. | 307/64 |
| 4,110,582 | 8/1978 | Barkan . | |
| 4,146,764 | 3/1979 | Wilson . | |
| 4,163,133 | 7/1979 | Bould . | |
| 4,167,988 | 9/1979 | Acampora et al. . | |
| 4,270,031 | 5/1981 | Borona et al. | 200/50 C |
| 4,286,242 | 8/1981 | Mrenna et al. | 335/160 |
| 4,295,054 | 10/1981 | Kovatch et al. | 307/80 |
| 4,359,611 | 11/1982 | Haskins | 200/1 TK |
| 4,398,097 | 8/1983 | Schell et al. | 307/64 |
| 4,404,446 | 9/1983 | Maier et al. | 209/320 |
| 4,409,449 | 10/1983 | Takano et al. . | |
| 4,423,336 | 12/1983 | Iverson et al. | 307/64 |
| 4,510,357 | 4/1985 | Winterbottom | 200/50 R |
| 4,523,769 | 6/1985 | Glaser et al. | 280/252 |
| 4,575,592 | 3/1986 | Rose | 200/6 R |
| 4,587,390 | 5/1986 | Gray . | |
| 4,596,310 | 6/1986 | Hatakeyama et al. . | |
| 4,672,227 | 6/1987 | Lagree et al. | 307/64 |
| 4,742,200 | 5/1988 | Marquardt et al. . | |
| 4,747,061 | 5/1988 | Lagree et al. | 364/483 |
| 4,760,278 | 7/1988 | Thomson | 307/64 |
| 4,791,255 | 12/1988 | Eliezer | 200/144 R |
| 4,827,089 | 5/1989 | Morris et al. | 200/50 C |
| 4,894,796 | 1/1990 | Engel et al. | 364/900 |
| 4,902,859 | 2/1990 | Witzmann et al. | 200/50 C |
| 4,924,041 | 5/1990 | Yee . | |
| 4,999,598 | 3/1991 | Jannesari et al. | 335/122 |
| 5,081,367 | 1/1992 | Smith et al. | 307/64 |

*Primary Examiner*—Ernest G. Cusick
*Attorney, Agent, or Firm*—Martin J. Moran

[57] ABSTRACT

A handle actuator is provided for a circuit interrupter that has a handle or toggle pivotally movable between operative positions. The handle actuator has a pair of pins that fit tightly on the handle, a pair of retainers coupling the pins in a rigidly spaced parallel relationship, and a pair of flanges fixed to the circuit interrupter via a base. The flanges are disposed on opposite sides of the handle and have arcuate slots that guide the pins coaxially with the pivot axis of the handle. The ends of the pins extend through the arcuate openings of the flanges and are received in the retainers. Connecting links pivotally couple the pins with a drive input for selectively driving the pins against the handle to move the handle between the operative positions. The relative position of the pins on both sides of the handle is constant, preventing wear on the handle due to rolling of the pins against the handle, impacts with the handle permitted by lost motion, or bending and twisting forces.

15 Claims, 2 Drawing Sheets

22
18
44
40
99
28
58
24
32
60
93
10
56
62
52
55
97
54
96
90
78
68
38
88
82
72
84
94
86
85
76
75
80
14
92
74
12
42
26
30
20
34
36
44

HANDLE ACTUATOR FOR A CIRCUIT INTERRUPTER HANDLE

CROSS-REFERENCE TO RELATED APPLICATIONS

The subject matter of this application is related to the subject matter of a copending concurrently-filed application entitled "TRANSFER SWITCH MECHANISM", by inventors George A. Smith, Thomas K. Fogle, Mark L. Lotzmann, and Robert N. Krevokuch Ser. No. 08/127,919; and application Ser. No. 07/874,861, filed 28 Apr. 1992, entitled "SPRING CHARGING MECHANISM FOR CIRCUIT BREAKERS AND TRANSFER SWITCHES", by inventor Stanislaw A. Milianowicz now U.S. Pat. No. 5,274,206, the latter application being incorporated herein by this reference. Both of the above-mentioned applications are assigned to the assignee of the present application.

BACKGROUND OF THE INVENTION

1. Field of the Invention

The invention relates to an actuator for displacing the toggle or handle of a circuit interrupter, and more particularly relates to a handle actuator that includes a pair of spaced opposed abutment surfaces for bearing against the handle along an arcuate path coincident with the motion of the handle, to thereby move the handle between progressive positions in a positive motion that does not wear the handle.

2. Prior Art

Circuit interrupters characteristically have OPEN and CLOSED positions at which an electrical circuit coupling a power-supplying source or line to a power-consuming load is broken or made, respectively. In some circuits, circuit interrupters are used simply as manual switches, while in other circuits they are used in conjunction with switching controls and/or circuit protection devices operable to open or close the circuit automatically.

Circuit interrupters characteristically include some form of handle or toggle. Despite having handles, certain large circuit interrupters are generally unsuitable for manual operation because substantial force is needed to operate them. For example, 150 to 300 pounds may be needed to move the handle of a high power interrupter between the OPEN and CLOSED positions, to overcome the force of springs and the like arranged to force the contacts together when closed and/or to drive them apart when opened. Such circuit interrupters may require that the electrician (or perhaps an electrically powered operator) have the aid of some mechanical advantage to move the handle, such as a lever arm extension.

In some applications for circuit interrupters, a handle actuator is provided. The handle actuator typically has a pair of opposed and rigidly spaced abutment surfaces disposed on opposite sides of the handle in the directions of movement, bearing against the handle to drive the handle from one position to the other. The abutment surfaces are moved, with the handle between them, one of the abutment surfaces bearing against the rear side of the handle in the direction of movement, forcing the handle from one position to the other. The handle actuator can be coupled to a drive input that is operable either remotely, manually, or both ways, although not generally at the same time.

The drive unit can be coupled mechanically to a drive means, or an electrically driven arrangement can be provided. A remotely-operated drive input is often plugged into a network of several interrupters that are centrally controlled elsewhere, for example by a computer or the like. A manually-operated drive input is advantageous for allowing an electrician (or other operator) to override the central controller, on site. It may also be appropriate to use a mechanical or electromechanical drive unit to gang together a plurality of circuit interrupters, for coordinated switching of loads. Examples of handle actuators include the transfer switches disclosed in U.S. Pat. No. 3,778,633—DeVisser et al.; U.S. Pat. No. 4,398,097—Schell et al.; U.S. Pat. No. 4,760,278—Thomson and U.S. Pat. No. 5,081,367—Smith et al. All of those patents involve either a pair of molded-case switches or a pair of molded-case circuit breakers.

These known handle actuators have several deficiencies, in part because the means engaging the handle does not complement the movement of the handle accurately. The handle actuators have handle-engaging abutment surfaces which slide or roll relative to the handle bearing against the handle for driving between the open and closed positions. This sliding and/or rolling erodes the handle, and with continued operation causes the handle to break.

Whereas the means engaging the handle does not complement the handle movement, the spaced abutment surfaces must define a space larger than the dimensions of the handle. That is, the handle-engaging abutment surfaces are spaced such that the handle fits loosely between them. The loose fit is necessary to avoid the abutment surfaces binding the handle as the handle moves between its positions. However, the loose fit results in lost motion, and when the beating direction of the abutment surfaces is flipped-flopped, the loose fit causes one of the abutment surfaces to strike the handle, or vice versa. Impacts between the actuator and the handle aggravate the wear and erosion of the handle.

Known handle actuators may have bulky and involved mechanisms, which are relatively expensive and inconvenient to mount for operatively engaging the handle actuator and the circuit interrupter. Mounting is a particular problem for the popular molded-case type of circuit breaker.

Known handle actuator mechanisms may be too flimsy for heavy duty circuit interrupters. Known manually-operated handle actuators also are prone to twisting between the handle and the abutment surfaces because the abutment surfaces are coupled to the drive input asymmetrically. Twisting further shortens the life of the handle, which already has a limited life due to erosion and the like from wear against the actuator abutment surfaces.

What is needed is an improvement over the known handle actuators for overcoming these and other deficiencies, in a durable and inexpensive actuator arranged to minimize wear on the circuit interrupter handle or toggle.

SUMMARY OF THE INVENTION

It is an object of the invention to provide a handle actuator which comprises a movable pair of opposed and spaced abutment surfaces for driving against a pivotal handle, wherein a substantially constant relative position is maintained between the handle and abutment surfaces as the handle is driven from one position to another.

It is another object of the invention to provide a handle actuator comprising a movable pair of opposed and spaced abutment surfaces for driving against a pivotal handle, wherein the abutment surfaces sweep in an arcuate path about an axis that is coincident with a pivot axis defined by the pivotal handle.

It is another object of the invention to provide a handle actuator which comprises a movable pair of opposed and spaced abutment surfaces for driving against a pivotal handle, wherein the abutment surfaces sweep in an arcuate path such that the lines of action (which are defined by forces transmitted between the abutment surfaces and the handle) are generally coincident with tangents of arcs about a pivot axis defined by the pivotal handle.

It is another object of the invention to provide a handle actuator which comprises a sweeping mechanical couple between a drive input and a pivotal handle, wherein the mechanical couple is arranged to preclude twisting of the handle.

It is another object of the invention to provide a handle actuator which comprises a connecting rod having opposite ends coupled to a drive input and a pivotal handle respectively, wherein the connecting rod sweeps bidirectionally in a plane of symmetry through the pivotal handle, said plane perpendicularly intersecting a pivot axis defined by the pivotal handle.

It is another object of the invention to provide a handle actuator which comprises a connecting rod having opposite ends coupled to a drive input and a pivotal handle respectively, wherein the connecting rod reciprocates generally linearly along a tangent of an arc about a pivot axis defined by the pivotal handle.

It is another object of the invention to provide a handle actuator comprising a pair of opposed and spaced abutment surfaces for driving against a pivotal handle, wherein the spacing between the abutment surfaces is such that the handle actuator closely fits the handle, thereby reducing wear.

It is another object of the invention to provide a handle actuator that includes a base permitting the handle actuator to simply be clapped together with and removably mounted directly on a commercially standard, molded-case circuit breaker.

It is another object of the invention to provide a handle actuator which is inexpensive and easy to manufacture, yet is strong and durable.

These and other objects are accomplished by a handle actuator for a circuit interrupter that has a handle movable reversibly between positions. The handle actuator comprises a pair of handle-engaging pins defining abutment surfaces, a pair of retainers coupling the pins in a spaced parallel relationship, a pair of stationary elongated flanges fastened to the interrupter, and a connecting rod coupled between the pins and a drive input. The spaced pins are arranged to straddle the handle in the directions of opposite motion. The elongated flanges are disposed on opposite sides of the handle and at right angles to the pins. The elongated flanges have opposed arcuate openings concentric with the pivot axis of the handle. The elongated pins have opposite end portions that extend through the arcuate openings of the flanges, thereby guiding the pins to follow the motion of the handle without relative displacement of the pins and the handle. The retainers are coupled to the ends of the pins such that the flanges are positioned between the retainers or, alternatively, the retainers may be positioned between the flanges.

The pins are guided back and forth in an arcuate path about the axis of the pivotal handle. As a result, the pins maintain a substantially constant relative position on the handle as the handle is driven between its positions. The pins do not slide back and forth against the handle, and the handle engaging structure defined by the pins can incline relative to the plane of the base in complementing the motion of the handle. Thus the pins can fit the handle tightly.

The connecting rod couples the pins with a drive input and comprises a proximal end coupled to one of the pins and a distal end coupled to the drive input. The distal end can be driven in a circular path. The proximal end may be connected to a U-shaped yoke rotatably coupled to one of the pins on opposite sides of the handle. The connecting rod generally reciprocates in a plane of symmetry through the handle, such plane intersecting the pivot axis defined by the pivotal handle at right angles. This symmetry reduces twisting between the handle and the pins during displacement of the handle.

A number of additional features and objects will also become apparent in connection with the following discussion of preferred embodiments and examples.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
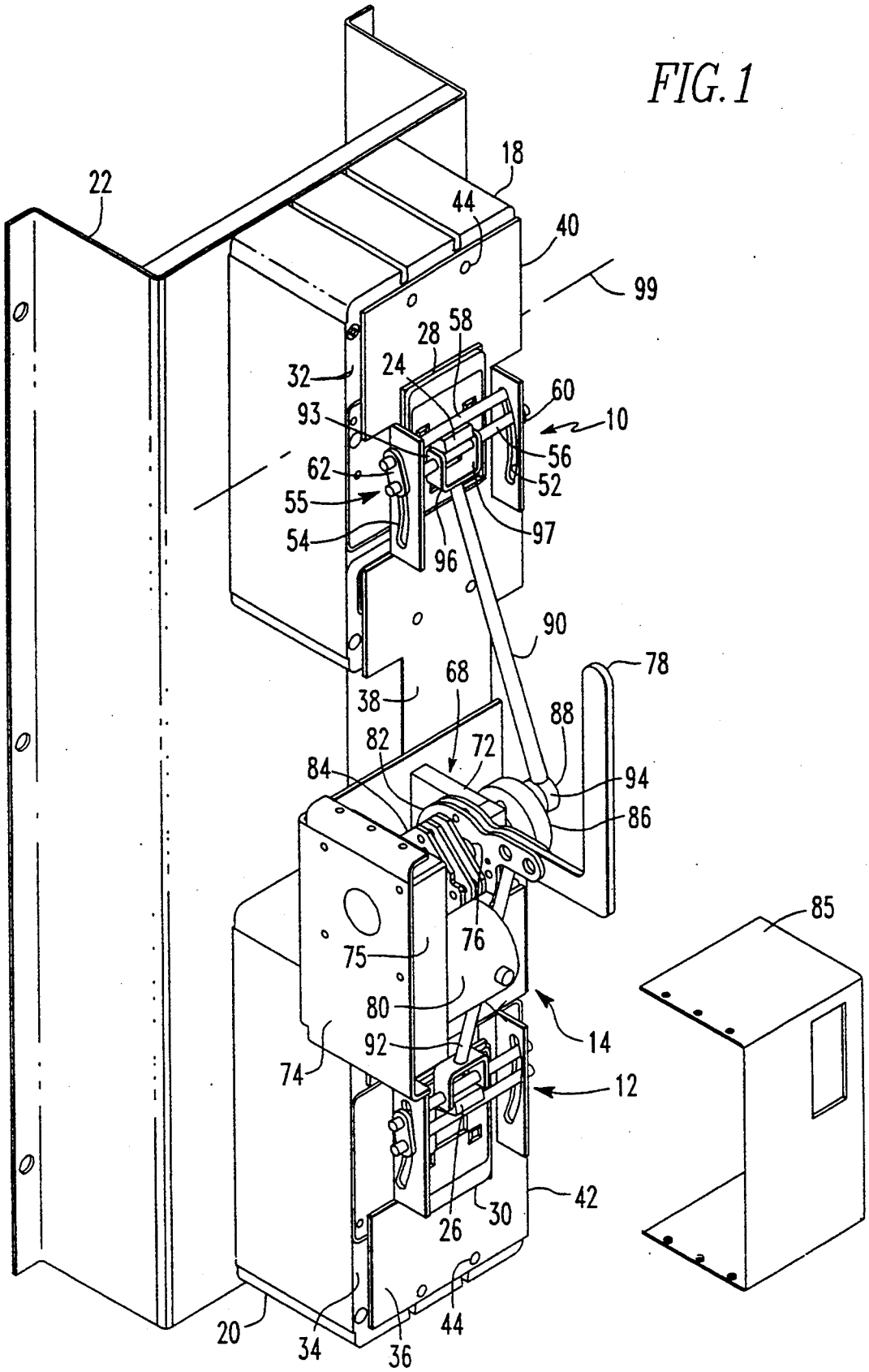
FIG. 1 is a perspective view of two handle actuators according to the invention, shown installed in a transfer switch power panel to illustrate an operative environment therefor.

In FIG. 1, a pair of handle actuators 10 and 12 are shown installed in a transfer switch power panel assembly 14. The transfer switch power panel assembly 14 is illustrative of one operative environment for the handle actuators 10 or 12, namely wherein two circuit interrupters are ganged for common operation. It will be appreciated that single and multiple handle actuators are also appropriate in many other applications, the transfer switch being only one example.

The transfer switch power panel assembly 14 includes a pair of circuit components, like molded-case circuit breakers 18 and 20, mounted in opposition to one another on a mounting structure 22. Alternatively, the circuit components 18 and 20 can be any of a pair of circuit interrupters, a pair of molded-case circuit switches, a pair of molded-case circuit breakers, or a pair of motor contactors.

Each circuit breaker 18, 20 has a handle or toggle 24, 26, projecting upwardly from a boss 28, 30 on an otherwise substantially planar surface 32, 34. The handles or toggles 24, 26 operate contacts internal to the circuit breaker or switch, which may include a current sensor operable to trip the breaker or switch when appropriate.

The transfer switch power panel assembly 14 further includes a planar base plate 36 attached on the planar surfaces 32 and 34 of the circuit breakers or switches 18 and 20. The circuit breakers 18 and 20 have cylindrical apertures (not shown) for receiving mounting fasteners that in turn attach directly to the mounting structure 22. The planar base plate 36 has a central segment 38 extending between opposite H-shaped portions 40 and 42, which may be channels or any other convenient shape. The planar H-shaped portions 40 and 42 are generally clapped against the planar surfaces 32 and 34 of the circuit breakers 18 and 20, and are releasably fixed in position by fasteners 44 that extend through cylindrical apertures in the circuit breaker or switch housings, and engage the mounting structure 22.

Figure 2:
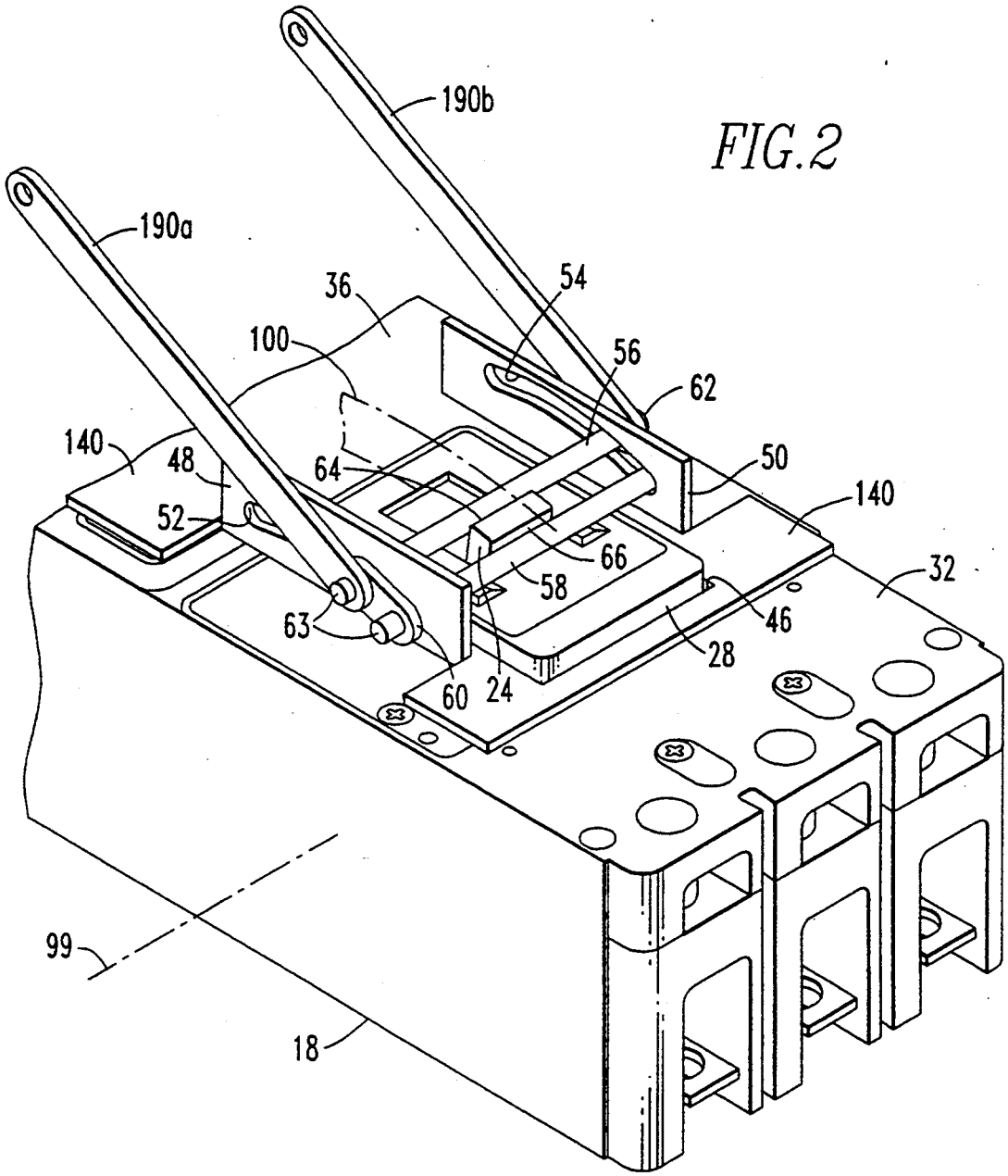
FIG. 2 is a perspective view of an alternate embodiment of a handle actuator according to the invention.

FIG. 2 shows the left circuit breaker or switch 18 from a point of view located in the upper left corner of FIG. 1. An alternative embodiment 110 of a handle actuator according to the invention is generally similar to the embodiment 10 or 12 in FIG. 1, except in particulars which will be specifically mentioned. With reference to FIG. 2, the circuit breaker or switch 18 supports the alternative embodiment 110. The H-shaped portion 140, which may be channel shaped, of the alternate embodiment 110 has a central rectangular opening 46. The rectangular opening 46 is sized for removably passing over the boss 28 of the circuit breaker or switch 18. The H-shaped portion 140 supports an opposed pair of standing flanges 48 and 50 on opposite sides of the rectangular opening 46, for example with the flanges being integral with the base plate and bent up from the plane of the base. The flanges 48 and 50 are provided with arcuate openings 52 and 54, concentric with the pivot axis of the toggle or handle.

The handle actuator 110 includes a head 55 which comprises a pair of elongate pins 56 and 58 and a pair of retainers 60 and 62 rigidly spacing the pins 56 and 58 in a parallel relationship. The pins 56 and 58 have opposite end portions 63 (the left side being shown in FIG. 2) extending through the arcuate openings 52 and 54 of the flanges 48 and 50. The retainers 60 and 62 are positioned with the flanges 48 and 50 disposed between the retainers 56 and 58 or, alternatively, the retainers 56 and 58 may be disposed between flanges 48 and 50. The spacing between the pins 56 and 58 is sized for closely fitting and straddling or flanking the handle 24 to eliminate lost motion as well as the potential for impact between the handle and the pins.

The handle 24 has a proximal surface portion 64 and a distal surface portion 66 adjacent the pins 56 and 58, respectively. The pins 56, 58 form a handle engaging means that engages the handle tightly and is mounted and guided, such that the relative position of the pins and the handle does not vary as the handle is moved. The surface portions 64 and 66 are generally planar. The pins 56 or 58 can have outer cylindrical-surface portions defining abutment surfaces for abutting against the handle surfaces 64 and 66, respectively, or alternatively the pins can have flat surfaces resting against the handle. Whereas the guide slots 52, 54 allow the pins to follow the arcuate motion of the handle at the area of engagement, there is no relative displacement of the pins and the handle and no need for the pins to roll. The pins 56 and 58 preferably define a line of contact on both sides of the handle surfaces 64 and 66, while abutting against the handle surfaces.

Returning to FIG. 1, the transfer switch power panel assembly 14 may include a drive system 68 that transmits a drive input to the handle actuators 10 and 12. The drive system 68 is more fully described in the copending patent application mentioned above entitled "TRANSFER SWITCH MECHANISM", and uses the ratchet and pawl assembly described in the copending patent application mentioned above entitled "SPRING CHARGING MECHANISM FOR CIRCUIT BREAKERS AND TRANSFER SWITCHES"—the latter being Ser. No. 07/874,861, filed 28 Apr. 1992, and incorporated herein. However, the drive system 68 is merely an example of a system for transmitting a drive input to the handle actuators 10 or 12, which can be mechanical or electrical, manual or driven, single or ganged, etc. The drive system 68 as shown is supported on a bracket 70 having an L-shaped cross section, fixed to the central segment 38 of the base plate 36. The bracket 70 supports a pillow block 72. An opposed wall 74 of the L-shaped bracket 70 supports a gear box 75. The pillow block 72 and gear box 75 cooperatively support a drive axle 76 for rotation about a rotation axis extending through the drive axle 76. A support bracket like another pillow block (not shown) can be substituted for the gear box 75 for non-motorized versions of the transfer switch power panel assembly 14.

The drive axle 76 is shown powered by alternative drive mechanisms, namely either by a lever arm (or hand grip) 78 or by an electric motor 80, in either case for rotating the mechanism on the drive axle and driving the pins at the distal ends of the device to displace the circuit breaker or switch 18 or 20 toggles or handles. The lever arm 78 is coupled to a ratchet assembly 82 and the electric motor 80 is coupled to another ratchet assembly 84 via gear train 75. The ratchet assemblies 82 and 84 are directly coupled to the drive axle 76 and in this embodiment constrain the rotation of the drive axle 76 to a single direction, namely the clockwise direction as viewed in FIG. 1. The drive system 68 is generally enclosed by a cover 85.

The drive axle 76 carries a drive crank 86 on an end that extends past the pillow block 72. The drive crank 86 rotates about a rotation axis coincident with the rotation axis of the drive axle 76. The drive crank 86 supports a pivot pin 88 at a position radially spaced away from these coincident rotation axes such that the pivot pin orbits them in a circular path.

A pair of connecting rods 90 and 92 cooperatively couple the drive crank 86 with the handle actuators 10 and 12 respectively. The left connecting rod 90, which is typical of the fight connecting rod 92, has a loop or ball joint rod end 94 pivotally connected to the pivot pin 88. The other end opposite to the loop or ball joint rod end 94 is mated to a U-shaped yoke 96. The U-shaped yoke 96 has opposite arms 97 and 98 terminating in spaced end portions which are pivotally coupled to the proximal pin 56 on opposite sides of the handle 24, thereby permitting the handle engaging structure including pins 56, 58 and retainers 60, 62 to pivot as needed to follow the arc of slot 54.

The handle actuators 10, 12 and 110 are operable reversibly to advance or retract through progressive positions ranging between proximal and distal extremes. With reference to FIG. 1, the handle actuator 10 is shown at the distal extreme position while the handle actuator 12 is shown at the proximal extreme position. In FIG. 2, the handle actuator 110 is shown at the distal position.

The handles 24 and 26 of the circuit breakers or switches 18 and 20 are likewise movable reversibly through progressive positions ranging between a proximal and distal position at which the circuit interrupters 18 and 20 are typically OPEN (break) or CLOSED (make). The handles of circuit breakers (and not necessarily switches) have stable positions at OPEN and CLOSED positions as well as at a TRIPPED position, which is about midway between the open and closed positions thereof; circuit breakers additionally may have an unstable RESET position as their extreme distal position (i.e., progressively past the stable CLOSED position thereof).

The sense of operation of the two coupled breakers or switches can be varied by appropriately orienting the two breakers or switches. For example, the handle 24 of the left circuit breaker or switch 18 (FIGS. 1 and 2) is shown in the CLOSED position while the handle 26 of the fight circuit breaker or switch 20 (FIG. 1 only) is shown in the OPEN position, i.e., the breakers or switches are typically arranged for opposite operation. It is also possible to control the breakers or switches to operate together in the same sense, by reversing one of them.

The circuit breaker or switch handles may have only two positions (OPEN and CLOSED), at which they remain stable due to springs (not shown) internal to the breakers or switches. Alternatively, the circuit breakers or switches 18 and 20 may be of the type that have a plurality of stable positions for the handles 24 and 26, additionally including an intermediate tripped position and/or a position beyond the open position to which the handle is moved to reset the breaker or switch. In that case, the handle actuator is operable to span the full range of the closed, tripped, open and reset positions.

The handle actuators 10 and 12 are operatively coupled to a suitable drive input, and there are a number of alternative types of drives. For example, the drive axle 76 as shown is drivable in the clockwise direction only either by the electric motor 80 (via gear train 75 and ratchet assembly 84) or lever arm 78 (via ratchet assembly 82). The lever arm 78 can be manually pumped (wherein power stroke is clockwise as viewed in FIG. 1). Clockwise rotation of the drive axle 76 results in clockwise rotation of the drive crank 86. The pivot pin 88 correspondingly orbits in a clockwise circular path.

The loop or ball joint rod end 94 of the left connecting rod 90 orbits in the clockwise direction in unison with the pivot pin 88. The left U-shaped yoke 96 is thus driven in the direction of left to right as viewed in FIG. 1. The left U-shaped yoke 96 is coupled to the distal handle-engaging pin 58 via interconnecting links which include the proximal handle-engaging pin 56 and opposite retainers 60 and 62. As the left U-shaped yoke 96 travels generally left to right (as viewed in FIG. 1), the distal handle-engaging pin 58 is driven against the distal surface 66 of the handle 24.

As shown in the figures, the distal pin 58 is preliminarily disposed in the DISTAL position. The distal pin 58 operates the handle 24 by bearing against the handle surface 66 to urge the handle 24 to move from the CLOSED position toward the OPEN position. The handle 24 defines a pivot axis 99 as the handle 24 is pivoted reversibly between the OPEN and CLOSED positions.

The base and arcuate slotted flanges form a mounting means movably supporting the head on the base, the mounting means maintaining a substantially constant relative position of the abutment surfaces on the handle as the handle is driven between its positions. Openings 52 and 54 define arcuate paths for the pins 56 and 58. The arcuate paths are coaxial with the pivot axis 99 defined by the pivotal handle 24. Consequently, the relative position of the distal pin 58 and distal surface 66 on the handle remains substantially constant while the handle 24 is driven. The constant relative position is such that the pin 58 neither slides nor rolls across the handle surface 66, thereby eliminating the problem of handle erosion. The line of action (which is defined as the direction of the force transmitted by the pin 58 to the surface 66) is generally coincident with a tangent of an arc about an axis coincident with the pivot axis 99.

As the left handle actuator 10 moves from the DISTAL position progressively toward the PROXIMAL position, the fight handle actuator 12 is simultaneously driven from its PROXIMAL position (as shown) progressively toward its DISTAL position. Thus the fight handle actuator 12 would progressively drive the handle 26 from the OPEN position (as shown) progressively toward the CLOSED position. The operation of the handle actuator 12 between the PROXIMAL and DISTAL positions is generally the reverse of the operation of the handle actuator 10 between the DISTAL and PROXIMAL positions respectively; however, this may involve either simultaneous or opposite making and breaking action of the breakers or switches.

The handle actuators 10 (or 12) and 110 are coupled to the drive input (e.g., drive system 68) in a manner that precludes twisting between the handle 24 and head 55 (i.e., pins 56 and 58). To this end, the connecting rod 90 generally moves in a plane of symmetry 100 through the handle 24, such plane of symmetry 100 intersecting the pivot axis 99 at fight angles. The connecting rod is arranged as a crank arm. However, for the most part the connecting rod reciprocates, because the circular path of the loop or ball joint rod end 94 defines a small diameter relative to the length of the connecting rod 90. The connecting rod 90 thus moves generally linearly along a tangent of an arc about an axis coincident with the pivot axis 99.

FIG. 2 shows an alternative embodiment for the connecting rod 90 of FIG. 1. The handle actuator 110 of FIG. 2 is operated by a pair of connecting links **190*a* and 190*b*. The connecting links 190*a* and 190*b* have proximal ends coupled to the proximal pin 56 and distal ends coupled to a drive input (not shown in FIG. 2). The connecting links 190*a* and 190*b* can be operated in the manner shown by FIG. 1, wherein the proximal ends of the links 190*a* and 190*b* are driven in circular paths. The connecting links 190*a* and 190*b* are disposed symmetrically about the plane of symmetry 100 through the handle 24, the plane of symmetry 100 intersecting the pivot axis 99 at fight angles to eliminate twist between the handle 24 and head 55**.

Both embodiments 10, 110 of the handle actuator have planar H-shaped or channel portions 40 and 140 clamped together with the generally planar surface 32 of circuit breaker or switch 18. Circuit breaker or switch 18 is representative of wide array of commercially available molded-case circuit breakers and molded-case switches having pivotal handles. Consequently, the handle actuators 10 and 110 according to the present invention can be easily scaled to any or most sizes of circuit breakers or switches. Applications for the handle actuators 10 and 110 include, among others, transfer switches and manually-pumped levers for gaining a mechanical advantage with large circuit interrupters. The handle actuators 10 and 110 cost relatively little to make and are easy to manufacture, yet strong and durable.

The invention having been disclosed in connection with the foregoing variations and examples, additional variations will now be apparent to persons skilled in the art. The invention is not intended to be limited to the variations specifically mentioned, and accordingly reference should be made to the appended claims, rather than the foregoing discussion of preferred examples, to assess the scope of the invention in which exclusive fights are claimed.

We claim:

1. A circuit component with a handle actuator, said circuit component having a general planar surface and said handle actuator having a handle that protrudes from said generally planar surface and which is moveable between operative positions, comprising:

a head having opposed abutment surfaces removably receiving the handle between the abutment surfaces, the head including a pair of elongated pins disposed in a rigidly spaced parallel relationship, the abutment surfaces on said pins fitting closely against the handle to substantially eliminate lost motion between the head and the handle;

driveable means connected to the head for transmitting a drive input to the head for driving the abutment surfaces against the handle for selectively moving the handle between the operative positions;

a base disposed upon said generally planar surface; and mounting means movably supporting the head on the base, the mounting means maintaining a substantially constant relative position of the abutment surfaces on the handle as the handle is driven between the operative positions.

2. The actuator of claim 1, wherein:

the mounting means comprises a spaced pair of flanges joined to the base on opposite sides of the handle; and, each flange has an arcuate opening defining a path of the head.

3. The actuator of claim 2, wherein;

opposite ends of said pins are slidably received in the arcuate openings.

4. The actuator of claim 3, wherein:

the arcuate openings are arranged such that the abutment surfaces move in an arcuate path about an axis that is coincident with a pivot axis of the handle.

5. The actuator of claim 1, wherein:

the drivable means comprises a pair of connecting rods; and, the connecting rods have distal ends coupled to the drive input and proximal ends pivotally coupled to the head on opposite sides of the handle.

6. A circuit component with a housing and handle actuator for a pivoted handle which protrudes from said housing and which is movable reversibly between operative positions, the actuator comprising:

handle engaging means defining a pair of abutment surfaces spaced to closely fit over the handle on opposite sides of the handle in a direction of motion;

drivable means coupled to the handle engaging means for transmitting a force to move the abutment surfaces in opposite directions against the handle and thereby to advance the handle between the operative positions;

a pair of flanges fixed relative to the housing on opposite sides of the handle, the flanges each having an arcuate opening; and, wherein the handle engaging means is coupled to the flanges at the arcuate openings such that the abutment surfaces are guided in arcuate paths about an axis that is coincident with a pivot axis defined by the pivotal handle.

7. The actuator of claim 6, wherein the handle engaging means comprises a pair of elongated pins disposed in a rigidly spaced parallel relationship.

8. The actuator of claim 7, wherein:

the elongated pins have opposite end portions that protrude into the arcuate openings in the flanges.

9. The actuator of claim 8, wherein:

the drivable means includes a pair of opposite retainers extending between and interconnecting the end portions of the elongated pins, the retainers holding the pins in the rigidly spaced relationship.

10. The actuator of claim 6, wherein:

the drivable means includes a connecting rod with one end connected to a U-shaped yoke; and, the U-shaped yoke has opposite arms pivotally coupled to the handle engaging means on opposite sides of the handle.

11. The actuator of claim 10, wherein:

the connecting rod is arranged to advance and retract in a plane of symmetry through the handle, said plane perpendicularly intersecting a pivot axis defined by the pivotal handle.

12. The actuator of claim 6, wherein:

the drivable means includes a pair of connecting rods; and, the connecting rods have distal ends coupled to the drive input and proximal ends pivotally coupled to the handle engaging means on opposite sides of the handle.

13. The actuator of claim 12, wherein:

the connecting rods are symmetrical about a plane of symmetry through the handle, said plane perpendicularly intersecting a pivot axis defined by the pivotal handle.

14. The actuator of claim 6 wherein:

the drivable means includes a connecting rod having a proximal end coupled to the handle-engaging means and a distal end driven in a circular path by the drive input.

15. A circuit component with a handle actuator, said circuit component having a generally planar surface and said handle actuator having a handle that protrudes from said generally planar surface and which is movable between operative positions, comprising:

the head having opposed abutment surfaces removably receiving the handle between the abutment surfaces;

driveable means connected to the head for transmitting a drive input to the head for driving the abutment surfaces against the handle for selectively moving the handle between the operative positions, the driveable means comprising a pair of connecting rods, the connecting rods having distal ends coupled to the drive input and proximal ends pivotally coupled to the head on opposites sides of the handle;

a base disposed upon said generally planar surface; and mounting means movably supporting the head on the base, the mounting means maintaining a substantially constant relative position of the abutment surfaces on the handle as the handle is driven between the operative positions.

* * * * *